US008376918B2

(12) United States Patent
Itzkowitz

(10) Patent No.: US 8,376,918 B2
(45) Date of Patent: Feb. 19, 2013

(54) LEG EXERCISING APPARATUS

(76) Inventor: Jay Itzkowitz, Boynton Bch, FL (US)

( * ) Notice: Subject to any disclaimer, the term of this patent is extended or adjusted under 35 U.S.C. 154(b) by 346 days.

(21) Appl. No.: 12/873,367

(22) Filed: Sep. 1, 2010

(65) Prior Publication Data

US 2012/0053025 A1 Mar. 1, 2012

(51) Int. Cl.
*A63B 21/02* (2006.01)

(52) U.S. Cl. ..... 482/121; 482/129; 482/130

(58) Field of Classification Search ..... 482/79, 482/121, 129, 130; 601/34, 35
See application file for complete search history.

(56) References Cited

U.S. PATENT DOCUMENTS 3,749,400 A * 7/1973 Stoffel ..... 482/123
4,621,620 A * 11/1986 Anderson ..... 601/34
7,309,320 B2 * 12/2007 Schmehl ..... 601/31

* cited by examiner

*Primary Examiner* — Glenn Richman

(57) ABSTRACT

A leg exerciser apparatus is disclosed. The leg exerciser apparatus comprises a frame disposed vertically, a base coupled to the frame, wherein the base comprises a linear track that extends horizontally, a foot receptacle that travels along the track, a means for providing resistance to the foot receptacle as it travels lengthwise along the track, a leg cuff that hangs from an upper portion of the frame such that a user may simultaneously place his upper leg within the leg cuff and his foot within the foot receptacle while the user's leg is in a bent position and a means for providing resistance to the leg cuff as it travels downwards, such that the apparatus provides resistance to the user's leg via the foot receptacle and the leg cuff as the user's leg is extended from the bent position.

18 Claims, 3 Drawing Sheets

LEG EXERCISING APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of exercise devices, and more particularly relates to the field of exercise devices for individuals requiring leg exercise due to injury or for those recuperating from surgery.

BACKGROUND OF THE INVENTION

For individuals recuperating from leg injuries or surgeries, exercise is a crucial element of the healing process. Leg surgery patients, or leg-injured individuals, often cannot move their legs in certain ways or positions due to pain stiffness, swelling, trauma and diminished neural control.

Various leg exercise devices do exist for leg surgery patients. U.S. Pat. No. 3,749,400 and U.S. Pat. No. 4,229,001, for example, disclose leg exercise devices comprising an adjustable element that rides on a horizontal track, such that a patient laying or sitting up in bed can push the adjustable element away with this foot or feet, thereby extending his leg or legs, and then bring the element back, thereby bending his leg or legs. Though these references provide a horizontal or lateral exercise that works out certain leg muscles, such as the quadriceps, these references do not provide a vertical or up-down exercise that works other important leg muscles, such as the hamstrings. Further, these references require that the patient have the ability to hold up his leg in a certain position, which is not possible for some leg surgery patients.

Moreover, U.S. Pat. No. 5,303,716 and U.S. Pat. Pub. No. 2005/0119095 disclose leg exercise devices comprising a platform that rises above the patient and a suspension system that suspends the patient's leg or legs, such that a patient laying or sitting up in bed can attempt to push his suspended leg or legs upwards or downwards. Although these references provide a vertical or up-down exercise that works out certain leg muscles, they do not teach a horizontal or lateral exercise that works out other important leg muscles, such as the quadriceps.

Therefore, a need exists to overcome the problems with the prior art as discussed above, and particularly for a leg exercise device for leg surgery or leg injury recuperation patients that provides an overall work out for the entire patient's leg or legs while requiring a minimal amount of control of the leg by the patient.

SUMMARY OF THE INVENTION

Briefly, according to an embodiment of the present invention, a leg exerciser apparatus is disclosed. The leg exerciser apparatus comprises a frame disposed vertically, a base coupled to the frame, wherein the base comprises a linear track that extends horizontally, a foot receptacle that travels along the track, a means for providing resistance to the foot receptacle as it travels lengthwise along the track, a leg cuff that hangs from an upper portion of the frame such that a user may simultaneously place his upper leg within the leg cuff and his foot within the foot receptacle while the user's leg is in a bent position and a means for providing resistance to the leg cuff as it travels downwards, such that the apparatus provides resistance to the user's leg via the foot receptacle and the leg cuff as the user's leg is extended from the bent position.

In another embodiment of the present invention, a leg exerciser apparatus is disclosed. The leg exerciser apparatus comprises a four-sided frame disposed vertically, an elongated base coupled perpendicularly to a bottom side of the frame, wherein the base comprises a linear track that extends horizontally, a foot receptacle that travels along the track, at least one spring coupled to the foot receptacle so as to provide resistance to the foot receptacle as it travels lengthwise along the track, a leg cuff that hangs from a top side of the frame such that a user may simultaneously place his upper leg within the leg cuff and his foot within the foot receptacle while the user's leg is in a bent position and at least one elastic band that attaches the leg cuff to the top side of the frame, so as to provide resistance to the leg cuff as it travels downwards, such that the apparatus provides resistance to the user's leg via the foot receptacle and the leg cuff as the user's leg is extended from the bent position.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention solves problems with the prior art by providing a simple and easy-to-use leg exerciser device that can be used by leg-surgery and leg-injured patients. The apparatus of the present invention further accommodates leg surgery or leg-injured patients that cannot move their legs in certain ways or positions due to pain stiffness, swelling, trauma and diminished neural control. Applicant's invention provides a horizontal or lateral exercise that works out certain leg muscles, such as the quadriceps, while also providing a vertical or up-down exercise that works other important leg muscles, such as the hamstrings. Further, the present invention does not require that the patient have the ability to hold up his leg in a certain position, which is not possible for some patients. In summary, the present invention provides a full workout for the leg of a patient, even if the patient has trouble controlling his leg or placing it in certain positions.

Figure 1:
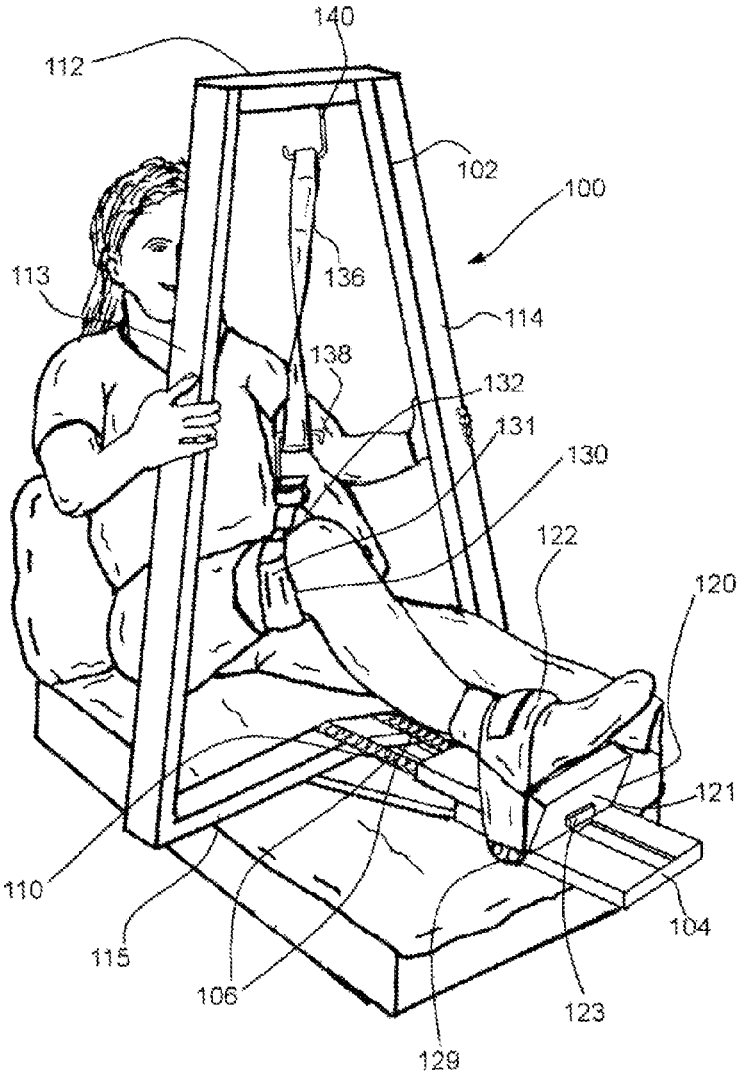
FIG. 1 is an illustration of a perspective view of the leg exerciser device, in accordance with one embodiment of the present invention.

FIG. 1 is an illustration of a perspective view of the leg exerciser device 100, in accordance with one embodiment of the present invention. FIG. 1 shows that device 100 includes a four-sided frame 102 disposed vertically. The frame 102 may be a trapezoid having its top side 112 parallel to its bottom side 115 and wherein the bottom side 115 is longer than the top side 112. The frame 102 may be constructed of wood and its right and left sides 113, 114 may be used for gripping by the patient while using the device 100. The present invention also supports other embodiments of the frame 102, such as a C-shaped frame comprising a lower side, an upper side and an extending element that connects the upper and lower sides.

FIG. 1 also shows that device 100 and includes an elongated base 104 coupled perpendicularly to a bottom side 115 of the frame 102, wherein the base comprises a linear track 110 that extends horizontally. The track 110 may be a raised metal bracket that extends along a length of the top side of the base 104. FIG. 1 also illustrates a foot receptacle 120 that travels along the track 110. The foot receptacle 120 further comprises an L-shaped bracket 121 for accepting the patient's foot and a strap 122 for securing the foot to the foot receptacle 120. The foot receptacle 120 may also include a track car 123 positioned on the underside of L-shaped bracket 121 for so as to engage the track 110 and travel along the track 110 over the base 104. The foot receptacle 120 may further include a hinge 129 that allows the vertical portion of the foot receptacle 120 to rotate about the hinge 129 as the horizontal portion of the foot receptacle 120 remains in a horizontal position.

FIG. 1 further shows resistance means in the form of two springs 106 coupling the foot receptacle 120 to the bottom side 115 of the frame 102 so as to provide resistance to the foot receptacle 120 as it travels lengthwise along the track 110 away from the frame 102. Each of the two springs 106 is coupled on one end to the bottom side 115 of the frame 102 and on the other end to the foot receptacle 120. The present invention supports other means for providing resistance to the foot receptacle 120 as it travels lengthwise along the track 110 away from the frame 102, such as rubber bands, air pressure or the like.

FIG. 1 also shows a leg cuff 130 that hangs from a top side 112 of the frame 102 such that the patient may simultaneously place his upper leg within the leg cuff 130 and his foot within the foot receptacle 120 while the patient's leg is in a bent position. The leg cuff 130 further comprises a strap 131 that wraps around the patient's upper leg and a removable fastener 132 that opens the strap 131 to allow the patient's leg to be inserted and removed from the strap 131. At least one elastic band 136 attaches the leg cuff 130 to the top side 112 of the frame 120, so as to provide resistance to the leg cuff 130 as it travels downwards. The present invention supports other means for providing resistance to the leg cuff as it travels downwards away from the top side 112 of the frame 102, such as rubber bands, air pressure or the like.

FIG. 1 also illustrates a first coupling device 138, such as a metal fastener, for coupling the leg cuff 130 to the at least one elastic band 136. Also shown is a second coupling device 140, such as a metal fastener, for coupling the at least one elastic band 136 to the top side 112 of the frame 102.

Figure 2:
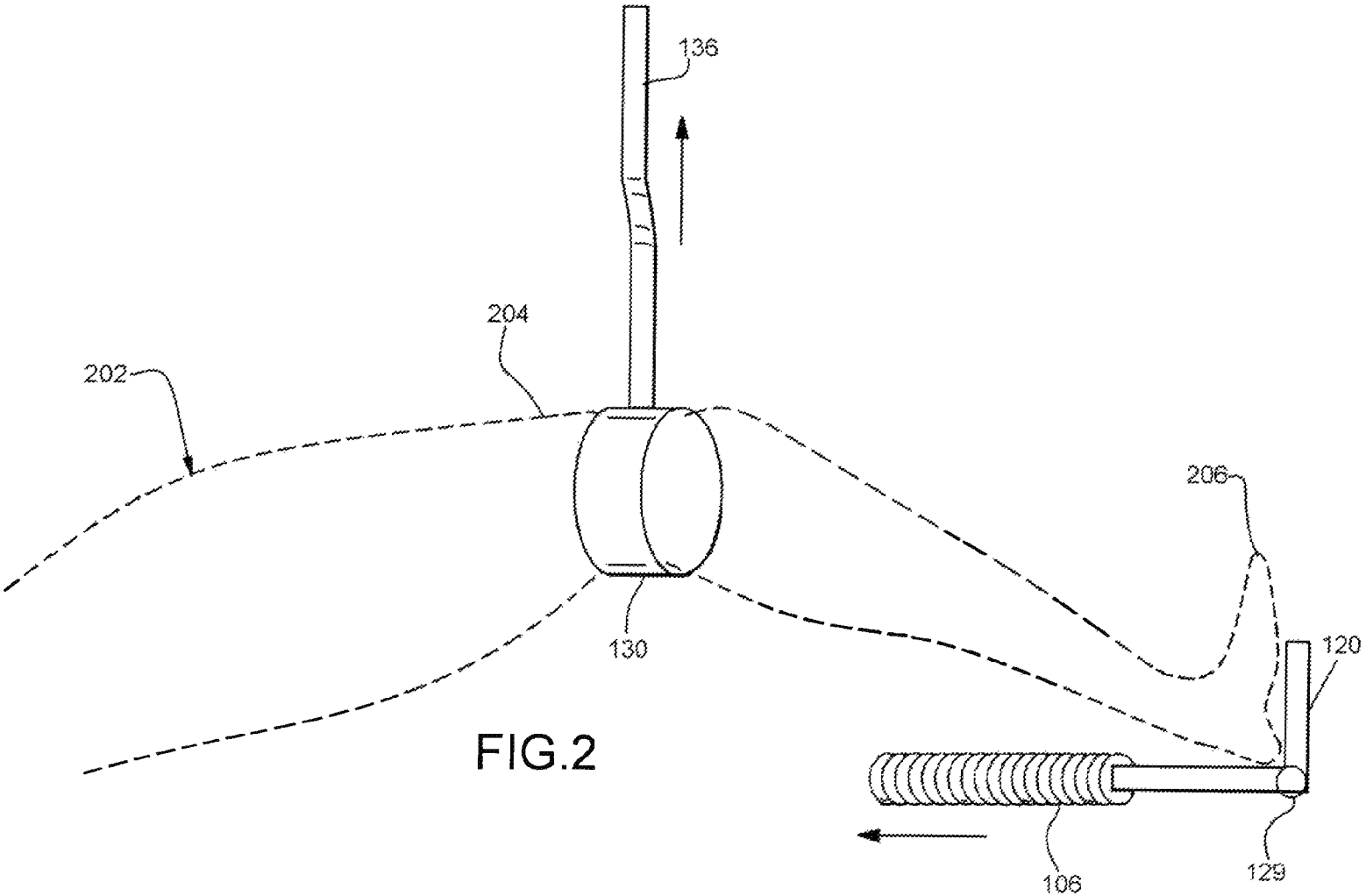
FIG. 2 is a conceptual force diagram from a side view of the leg exerciser device when the patient's leg is bent, in accordance with one embodiment of the present invention.

FIG. 2 is a conceptual force diagram from a side view of the leg exerciser device 100 when the patient's leg 202 is in a bent position, in accordance with one embodiment of the present invention. FIG. 2 shows that the upper portion 204 of the patient's leg 202 is placed within the leg cuff 130, which hangs from the frame 102 via one or more elastic bands 136. The elastic bands 136 provide resistance in the upward direction, i.e., the elastic bands pull the patient's leg 202 upwards. FIG. 2 also shows that the patient's foot 206 is placed in the foot receptacle 120, which is coupled to the frame 102 via one or more springs 106. The springs 106 provide resistance in the left direction towards the patient's body, i.e., the springs 106 pull the patient's leg 202 towards the left.

Note that FIG. 2 shows a hinge 129 that allows the vertical portion of the foot receptacle 120 to rotate about the hinge 129 as the horizontal portion of the foot receptacle 120 remains in a horizontal position. When the patient's leg 202 is in the bent position, the patient's foot 206 goes into plantar flexion, i.e., the foot rotates outwards away from the patient's body. This action is accommodated by the hinge 129 which allows the vertical portion of the foot receptacle 120 to rotate away from the horizontal portion of the foot receptacle 120, which remains in a horizontal position.

Figure 3:
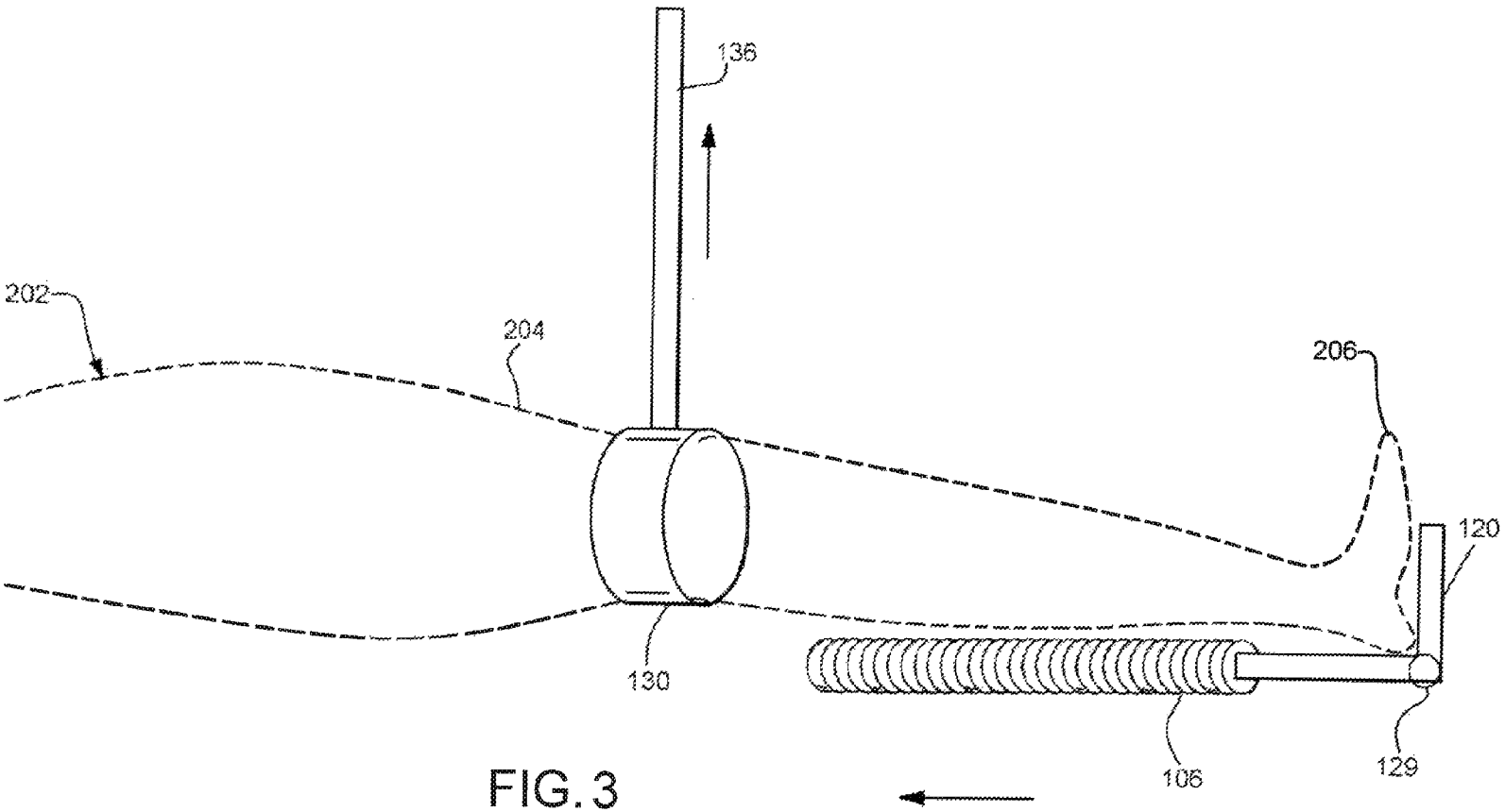
FIG. 3 is a conceptual force diagram from a side view of the leg exerciser device when the patient's leg is extended, in accordance with one embodiment of the present invention.

FIG. 3 is a conceptual force diagram from a side view of the leg exerciser device 100 when the patient's leg 202 is in the extended position, in accordance with one embodiment of the present invention. FIG. 2 shows that the patient's leg 202 has been extended such that the upper portion 204 of the patient's leg 202 is in line or collinear with the lower portion of the patient's leg. As the patient's leg is extended, the one or more elastic bands 136 are stretched in the downwards position and therefore the elastic bands 136 provide greater resistance in the upwards direction, i.e., the elastic bands pull the patient's leg 202 upwards with a greater force. FIG. 2 also shows that as the patient's foot 206 and the foot receptacle 120 move to the right, the one or more springs 106 are stretched out horizontally and the springs 106 provide greater resistance in the left direction towards the patient's body, i.e., the springs 106 pull the patient's leg 202 towards the left with a greater force. In this fashion, the patient's leg 202 receives a full workout, as the patient must extend and contract his leg muscles to push the receptacle 120 outwards and pull leg cuff 130 downwards.

Note that when the patient's leg 202 is in the extended position, the patient's foot 206 goes into dorsi-flexion, i.e., the foot rotates outwards towards the patient's body. This action is accommodated by the hinge 129 which allows the vertical portion of the foot receptacle 120 to rotate towards the horizontal portion of the foot receptacle 120.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

The invention claimed is:

1. A leg exerciser apparatus, comprising:

a frame disposed vertically;

a base coupled to the frame, wherein the base comprises a linear track that extends horizontally;

a foot receptacle that travels along the track;

a means for providing resistance to the foot receptacle as it travels lengthwise along the track;

a leg cuff that hangs from an upper portion of the frame such that a user may simultaneously place his upper leg within the leg cuff and his foot within the foot receptacle while the user's leg is in a bent position; and a means for providing resistance to the leg cuff as it travels downwards, such that the apparatus provides resistance to the user's leg via the foot receptacle and the leg cuff as the user's leg is extended from the bent position.

2. The leg exerciser apparatus of claim 1, wherein the frame further comprises a four-sided shape.

3. The leg exerciser apparatus of claim 2, wherein the frame further comprises a trapezoid having its top side parallel to its bottom side and wherein the bottom side is longer than the top side.

4. The leg exerciser apparatus of claim 1, wherein the base further comprises an elongated element coupled perpendicularly to a bottom side of the frame.

5. The leg exerciser apparatus of claim 4, wherein the foot receptacle further comprises an L-shaped bracket for accepting a foot and a strap for securing the foot to the foot receptacle.

6. The leg exerciser apparatus of claim 5, wherein the means for providing resistance to the foot receptacle further comprises at least one spring coupled on one end to the frame and on another end to the foot receptacle, such that the at least one spring provides resistance to the foot receptacle as it travels along the track away from the frame.

7. The leg exerciser apparatus of claim 1, wherein the leg cuff further comprises a strap that wraps around a user's upper leg and a removable fastener that opens the strap to allow the user's leg to be inserted and removed from the strap.

8. The leg exerciser apparatus of claim 7, wherein the means for providing resistance to the leg cuff further comprises one or more elastic bands coupled on one end to a top side of the frame and on the other end to the cuff, such that the one or more elastic bands provide resistance to the leg cuff as it travels downwards.

9. The leg exerciser apparatus of claim 8, further comprising a first coupling device for coupling the leg cuff to the one or more elastic bands.

10. The leg exerciser apparatus of claim 9, further comprising a second coupling device for coupling the one or more elastic bands to the upper portion of the frame.

11. A leg exerciser apparatus, comprising:

a four-sided frame disposed vertically;

an elongated base coupled perpendicularly to a bottom side of the frame, wherein the base comprises a linear track that extends horizontally;

a foot receptacle that travels along the track;

at least one spring coupled to the foot receptacle so as to provide resistance to the foot receptacle as it travels lengthwise along the track;

a leg cuff that hangs from a top side of the frame such that a user may simultaneously place his upper leg within the leg cuff and his foot within the foot receptacle while the user's leg is in a bent position; and at least one elastic band that attaches the leg cuff to the top side of the frame, so as to provide resistance to the leg cuff as it travels downwards, such that the apparatus provides resistance to the user's leg via the foot receptacle and the leg cuff as the user's leg is extended from the bent position.

12. The leg exerciser apparatus of claim 11, wherein the frame further comprises a trapezoid having its top side parallel to its bottom side and wherein the bottom side is longer than the top side.

13. The leg exerciser apparatus of claim 11, wherein the track a raised metal bracket that extends along a length of the base.

14. The leg exerciser apparatus of claim 13, wherein the foot receptacle further comprises an L-shaped bracket for accepting a foot and a strap for securing the foot to the foot receptacle.

15. The leg exerciser apparatus of claim 14, wherein the at least one spring is coupled on one end to the frame and on another end to the foot receptacle, such that the at least one spring provides resistance to the foot receptacle as it travels along the track away from the frame.

16. The leg exerciser apparatus of claim 11, wherein the leg cuff further comprises a strap that wraps around a user's upper leg and a removable fastener that opens the strap to allow the user's leg to be inserted and removed from the strap.

17. The leg exerciser apparatus of claim 16, further comprising a first coupling device for coupling the leg cuff to the at least one elastic band.

18. The leg exerciser apparatus of claim 17, further comprising a second coupling device for coupling the at least one elastic band to the top side of the frame.

* * * * *